US006695067B2

(12) United States Patent
Johnson et al.

(10) Patent No.: US 6,695,067 B2
(45) Date of Patent: Feb. 24, 2004

(54) WELLBORE ISOLATION TECHNIQUE

(75) Inventors: Craig D. Johnson, Montogomery, TX (US); Patrick W. Bixenman, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 10/021,697

(22) Filed: Dec. 12, 2001

(65) Prior Publication Data

US 2002/0092658 A1 Jul. 18, 2002

Related U.S. Application Data

(60) Provisional application No. 60/296,092, filed on Jun. 5, 2001, provisional application No. 60/261,895, filed on Jan. 16, 2001, provisional application No. 60/263,970, filed on Jan. 24, 2001, and provisional application No. 60/261,732, filed on Jan. 16, 2001.

(51) Int. Cl.[7] ..... E21B 33/12

(52) U.S. Cl. ..... 166/387; 166/195; 166/207; 166/230

(58) Field of Search ..... 166/387, 180, 166/181, 195, 196, 207, 230, 232, 236, 277

(56) References Cited

U.S. PATENT DOCUMENTS

| | | | | |
|---|---|---|---|---|
| 1,301,285 | A | | 4/1919 | Leonard |
| 3,297,092 | A | | 1/1967 | Jennings |
| 3,353,599 | A | | 11/1967 | Swift |
| 3,419,080 | A | | 12/1968 | Lebourg |
| 3,489,220 | A | | 1/1970 | Kinley |
| 3,604,732 | A | * | 9/1971 | Malone ..... 285/106 |
| 5,348,095 | A | | 9/1994 | Worrall et al. |
| 5,366,012 | A | | 11/1994 | Lohbeck |
| 5,667,011 | A | | 9/1997 | Gill et al. |
| 5,901,789 | A | | 5/1999 | Donnelly et al. |
| 5,984,568 | A | | 11/1999 | Lohbeck |
| 6,012,522 | A | | 1/2000 | Donnelly et al. |
| 6,070,671 | A | | 6/2000 | Cumming et al. |
| 6,135,208 | A | | 10/2000 | Gano et al. |
| 6,142,230 | A | | 11/2000 | Smalley et al. |
| 6,250,385 | B1 | | 6/2001 | Montaron |
| 6,253,850 | B1 | | 7/2001 | Nazzai et al. |
| 6,263,972 | B1 | * | 7/2001 | Richard et al. ..... 166/381 |
| 6,273,634 | B1 | | 8/2001 | Lohbeck |
| 6,325,148 | B1 | | 12/2001 | Trahan et al. |
| 6,431,271 | B1 | * | 8/2002 | Thomeer et al. ..... 166/77.51 |

FOREIGN PATENT DOCUMENTS

| | | |
|---|---|---|
| GB | 2 371 064 A | 7/2002 |
| WO | WO 96/37680 | 11/1996 |
| WO | WO 98/00626 | 1/1998 |
| WO | WO 98/22690 | 5/1998 |
| WO | WO 98/26152 | 6/1998 |
| WO | WO 98/49423 | 11/1998 |
| WO | WO 99/02818 | 1/1999 |
| WO | WO 99/23354 | 5/1999 |

* cited by examiner

*Primary Examiner*—Zakiya Walker
(74) *Attorney, Agent, or Firm*—Van Someren, PC; Jeffrey E. Griffin; Brigitte Jeffery Echols

(57) ABSTRACT

A wellbore isolation device having an expandable component. The expandable component comprises a layer of bistable cells that can be expanded from a contracted stable state towards an expanded stable state. A seal material may be placed along the expandable cells to facilitate inhibition of fluid flow along a region of a wellbore.

37 Claims, 16 Drawing Sheets

WELLBORE ISOLATION TECHNIQUE

CROSS REFERENCE TO RELATED APPLICATIONS

The following is based on and claims the benefit of provisional application No. 60/296,092 filed Jun. 5, 2001, provisional application No. 60/261,895 filed Jan. 16, 2001, provisional application No. 60/263,970 filed Jan. 24, 2001 and provisional application No. 60/261,732 filed Jan. 16, 2001.

FIELD OF THE INVENTION

This invention relates to equipment that can be used in the drilling and completion of boreholes in an underground formation and in the production of fluids from such wells.

BACKGROUND OF THE INVENTION

Fluids such as oil, natural gas and water are obtained from a subterranean geologic formation (a "reservoir") by drilling a well that penetrates the fluid-bearing formation. Once the well has been drilled to a certain depth the borehole wall is supported to prevent collapse.

In many applications, it is desirable to isolate portions of the wellbore. Typically, one or more packers are deployed within the casing string and moved to a desired location within the wellbore. The packer is expanded at the desired location to form a boundary to fluid flow from one region of the wellbore to another. Often, packers are deployed with other tubulars to isolate desired regions of the annulus formed around the tubular.

It would be desirable to have a simple, functional wellbore isolation device able to function as a packer and/or a variety of other types of isolation devices.

SUMMARY OF THE INVENTION

In one aspect of the present invention, a technique is provided for isolating regions of a wellbore from unwanted fluid flow. The technique utilizes an expandable member that may be deployed at a desired location in a wellbore and then expanded outwardly. According to one aspect of the invention, the expandable device is utilized as a packer.

BRIEF DESCRIPTION OF THE DRAWINGS

The invention will hereafter be described with reference to the accompanying drawings, wherein like reference numerals denote like elements, and.

Figure 1A:
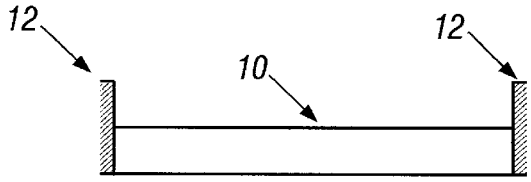
FIGS. 1A and 1B are illustrations of the forces imposed to make a bistable structure.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DETAILED DESCRIPTION OF EXEMPLARY EMBODIMENTS

Figure 1B:
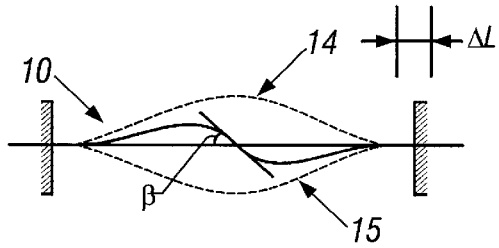

Bistable devices used in the present invention can take advantage of a principle illustrated in FIGS. 1A and 1B. FIG. 1A shows a rod 10 fixed at each end to rigid supports 12. If the rod 10 is subjected to an axial force it begins to deform as shown in FIG. 1B. As the axial force is increased rod 10 ultimately reaches its Euler buckling limit and deflects to one of the two stable positions shown as 14 and 15. If the buckled rod is now clamped in the buckled position, a force at right angles to the long axis can cause the rod to move to either of the stable positions but to no other position. When the rod is subjected to a lateral force it must move through an angle $\beta$ before deflecting to its new stable position.

Figure 2A:
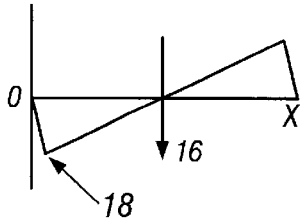
FIGS. 2A and 2B show force-deflection curves of two bistable structures.
Figure 2B:
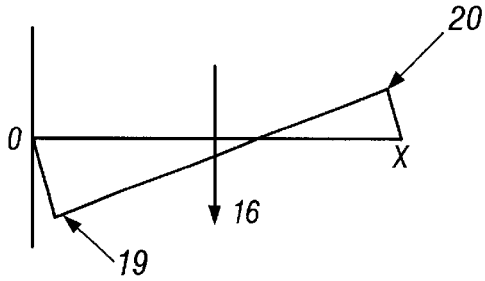

Bistable systems are characterized by a force deflection curve such as those shown in FIGS. 2A and 2B. The externally applied force 16 causes the rod 10 of FIG. 1B to move in the direction X and reaches a maximum 18 at the onset of shifting from one stable configuration to the other. Further deflection requires less force because the system now has a negative spring rate and when the force becomes zero the deflection to the second stable position is spontaneous.

The force deflection curve for this example is symmetrical and is illustrated in FIG. 2A. By introducing either a precurvature to the rod or an asymmetric cross section the force deflection curve can be made asymmetric as shown in FIG. 2B. In this system the force 19 required to cause the rod to assume one stable position is greater than the force 20 required to cause the reverse deflection. The force 20 must be greater than zero for the system to have bistable characteristics.

Bistable structures, sometimes referred to as toggle devices, have been used in industry for such devices as flexible discs, over center clamps, hold-down devices and quick release systems for tension cables (such as in sailboat rigging backstays).

Figure 3A:
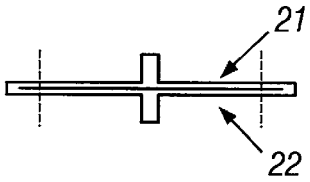
FIGS. 3A–3F illustrate expanded and collapsed states of three bistable cells with various thickness ratios.
Figure 3B:
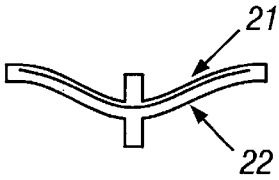
Figure 3C:
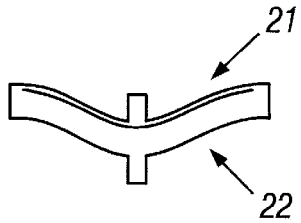
Figure 3D:
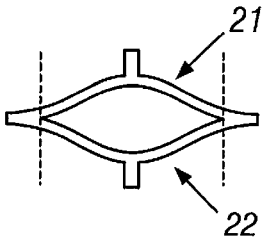
Figure 3E:
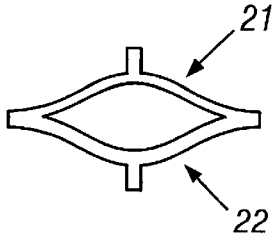
Figure 3F:
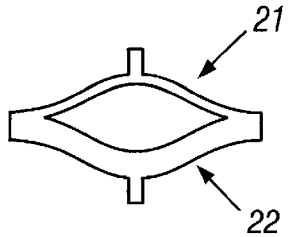

Instead of using the rigid supports as shown in FIGS. 1A and 1B, a cell can be constructed where the restraint is provided by curved struts connected at each end as shown in FIGS. 3A–3F. If both struts 21 and 22 have the same thickness as shown in FIGS. 3A and 3B, the force deflection curve is linear and the cell lengthens when compressed from its open position FIG. 3B to its closed position FIG. 3A. If the cell struts have different thicknesses, as shown in FIGS. 3C–3F, the cell has the force deflection characteristics shown in FIG. 2B, and does not change in length when it moves between its two stable positions. An expandable bistable tubular can thus be designed so that as the radial dimension expands, the axial length remains constant. In one example, if the thickness ratio is over approximately 2:1, the heavier strut resists longitudinal changes. By changing the ratio of thick-to-thin strut dimensions, the opening and closing forces can be changed. For example, FIGS. 3C and 3D illustrated a thickness ratio of approximately 3:1, and FIGS. 3E and 3F illustrate a thickness ratio of approximately 6:1.

Figure 4A:
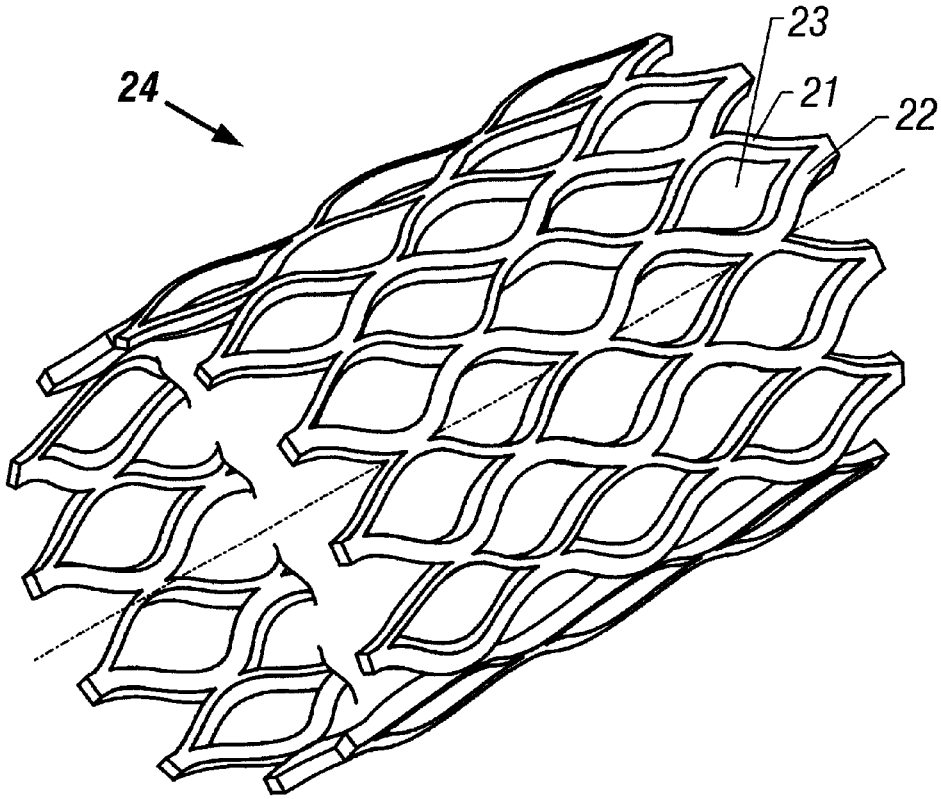
FIGS. 4A and 4B illustrate a bistable expandable tubular in its expanded and collapsed states.
Figure 4B:
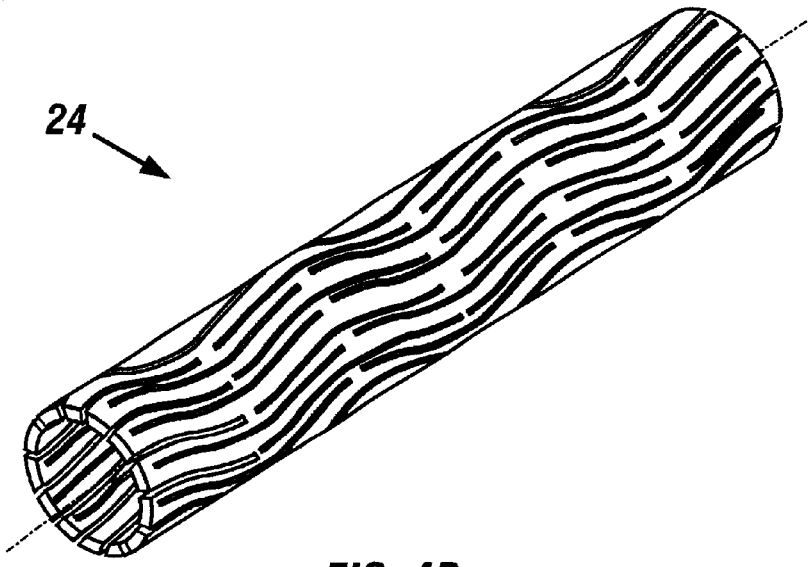
Figure 4C:
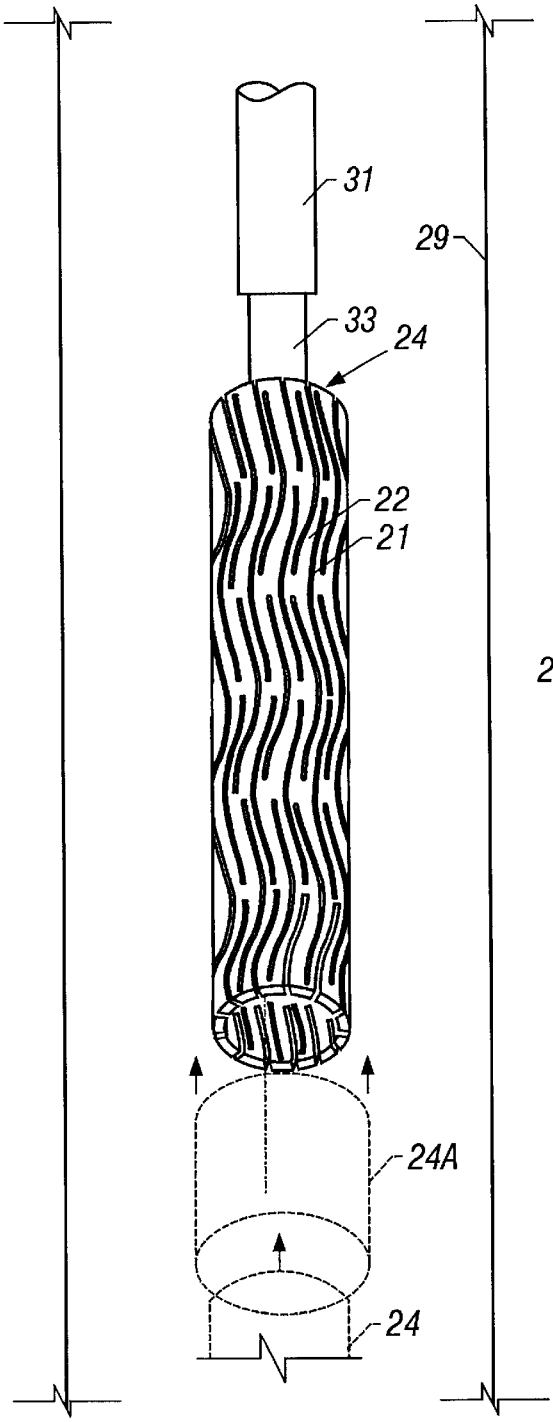
FIGS. 4C and 4D illustrate a bistable expandable tubular in collapsed and expanded states within a wellbore.
Figure 4D:
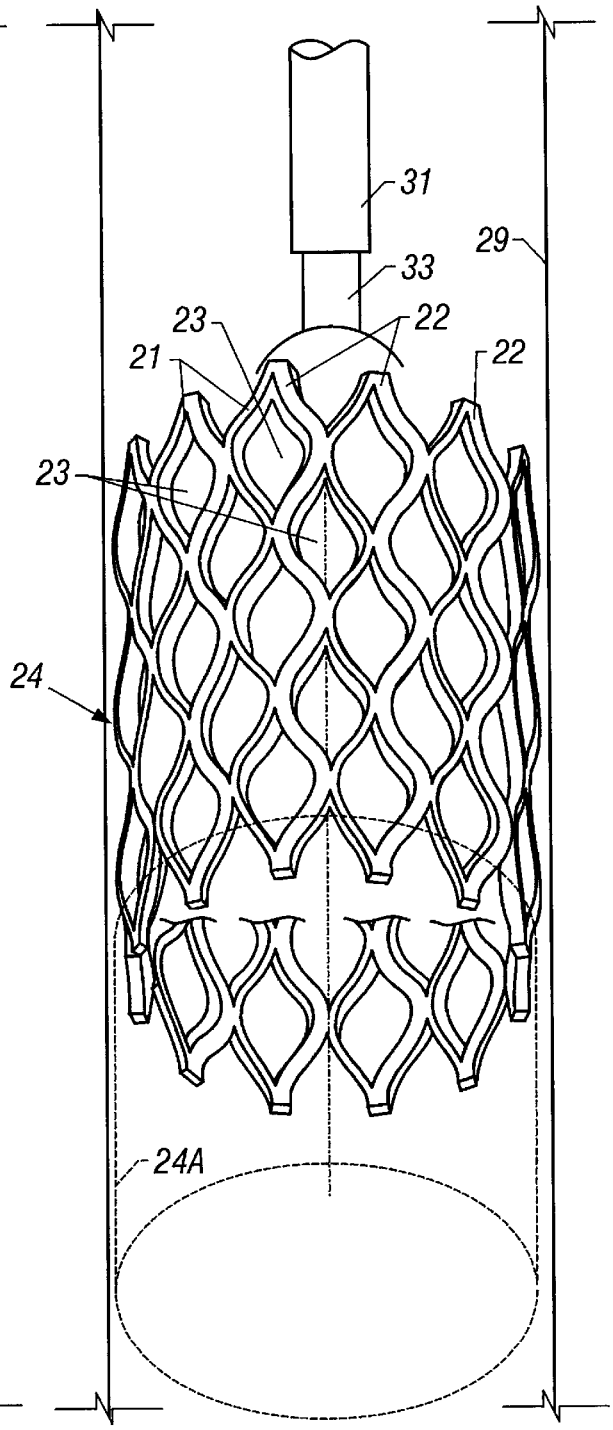

An expandable bore bistable tubular, such as casing, a tube, a patch, or pipe, can be constructed with a series of circumferential bistable connected cells 23 as shown in FIGS. 4A and 4B, where each thin strut 21 is connected to a thick strut 22. The longitudinal flexibility of such a tubular can be modified by changing the length of the cells and by connecting each row of cells with a compliant link. Further, the force deflection characteristics and the longitudinal flexibility can also be altered by the design of the cell shape. FIG. 4A illustrates an expandable bistable tubular 24 in its expanded configuration while FIG. 4B illustrates the expandable bistable tubular 24 in its contracted or collapsed configuration. Within this application the term "collapsed" is used to identify the configuration of the bistable element or device in the stable state with the smallest diameter, it is not meant to imply that the element or device is damaged in any way. In the collapsed state, bistable tubular 24 is readily introduced into a wellbore 29, as illustrated in FIG. 4C. Upon placement of the bistable tubular 24 at a desired wellbore location, it is expanded, as illustrated in FIG. 4D.

The geometry of the bistable cells is such that the tubular cross-section can be expanded in the radial direction to increase the overall diameter of the tubular. As the tubular expands radially, the bistable cells deform elastically until a specific geometry is reached. At this point the bistable cells move, e.g. snap, to a final expanded geometry. With some materials and/or bistable cell designs, enough energy can be released in the elastic deformation of the cell (as each bistable cell snaps past the specific geometry) that the expanding cells are able to initiate the expansion of adjoining bistable cells past the critical bistable cell geometry. Depending on the deflection curves, a portion or even an entire length of bistable expandable tubular can be expanded from a single point.

In like manner if radial compressive forces are exerted on an expanded bistable tubular, it contracts radially and the bistable cells deform elastically until a critical geometry is reached. At this point the bistable cells snap to a final collapsed structure. In this way the expansion of the bistable tubular is reversible and repeatable. Therefore the bistable tubular can be a reusable tool that is selectively changed between the expanded state as shown in FIG. 4A and the collapsed state as shown in FIG. 4B.

In the collapsed state, as in FIG. 4B, the bistable expandable tubular is easily inserted into the wellbore and placed into position. A deployment device is then used to change the configuration from the collapsed state to the expanded state.

In the expanded state, as in FIG. 4A, design control of the elastic material properties of each bistable cell can be such that a constant radial force can be applied by the tubular wall to the constraining wellbore surface. The material properties and the geometric shape of the bistable cells can be designed to give certain desired results.

Figure 11:
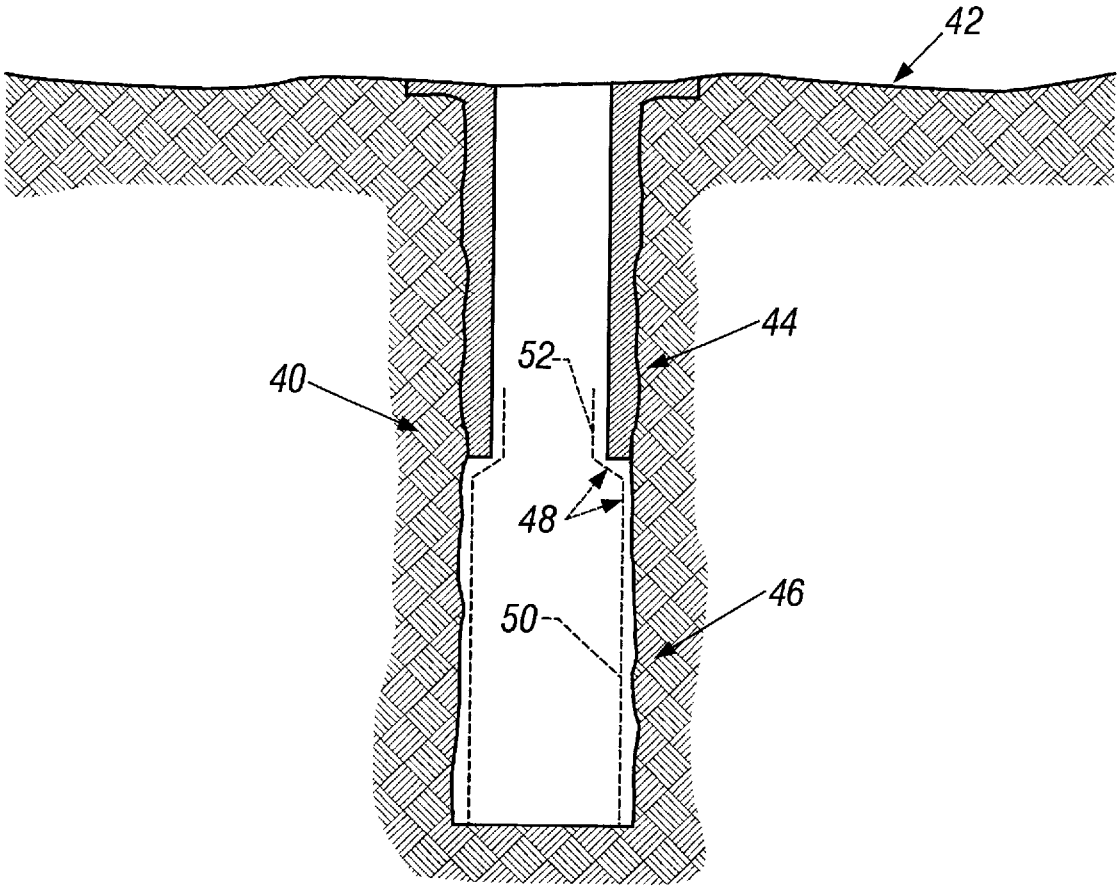
FIG. 11 is a schematic of a wellbore utilizing an expandable bistable tubular.

One example of designing for certain desired results is an expandable bistable tubular string with more than one diameter throughout the length of the string. This can be useful in boreholes with varying diameters, whether designed that way or as a result of unplanned occurrences such as formation washouts or keyseats within the borehole. This also can be beneficial when it is desired to have a portion of the bistable expandable device located inside a cased section of the well while another portion is located in an uncased section of the well. FIG. 11 illustrates one example of this condition. A wellbore 40 is drilled from the surface 42 and comprises a cased section 44 and an openhole section 46. An expandable bistable device 48 having segments 50, 52 with various diameters is placed in the well. The segment with a larger diameter 50 is used to stabilize the openhole section 46 of the well, while the segment having a reduced diameter 52 is located inside the cased section 44 of the well.

Bistable collars or connectors 24A (see FIG. 4C) can be designed to allow sections of the bistable expandable tubular to be joined together into a string of useful lengths using the same principle as illustrated in FIGS. 4A and 4B. This bistable connector 24A also incorporates a bistable cell design that allows it to expand radially using the same mechanism as for the bistable expandable tubular component. Exemplary bistable connectors have a diameter slightly larger than the expandable tubular sections that are being joined. The bistable connector is then placed over the ends of the two sections and mechanically attached to the expandable tubular sections. Mechanical fasteners such as screws, rivets or bands can be used to connect the connector to the tubular sections. The bistable connector typically is designed to have an expansion rate that is compatible with the expandable tubular sections, so that it continues to connect the two sections after the expansion of the two segments and the connector.

Alternatively, the bistable connector can have a diameter smaller than the two expandable tubular sections joined. Then, the connector is inserted inside of the ends of the tubulars and mechanically fastened as discussed above. Another embodiment would involve the machining of the ends of the tubular sections on either their inner or outer surfaces to form an annular recess in which the connector is located. A connector designed to fit into the recess is placed in the recess. The connector would then be mechanically attached to the ends as described above. In this way the connector forms a relatively flush-type connection with the tubular sections.

A conveyance device 31 transports the bistable expandable tubular lengths and bistable connectors into the wellbore and to the correct position. (See FIGS. 4C and 4D). The conveyance device may utilize one or more mechanisms such as wireline cable, coiled tubing, coiled tubing with wireline conductor, drill pipe, tubing or casing.

A deployment device 33 can be incorporated into the overall assembly to expand the bistable expandable tubular and connectors. (See FIGS. 4C and 4D). Deployment devices can be of numerous types such as an inflatable packer element, a mechanical packer element, an expandable swage, a piston apparatus, a mechanical actuator, an electrical solenoid, a plug type apparatus, e.g. a conically shaped device pulled or pushed through the tubing, a ball type apparatus or a rotary type expander as further discussed below.

Figure 5A:
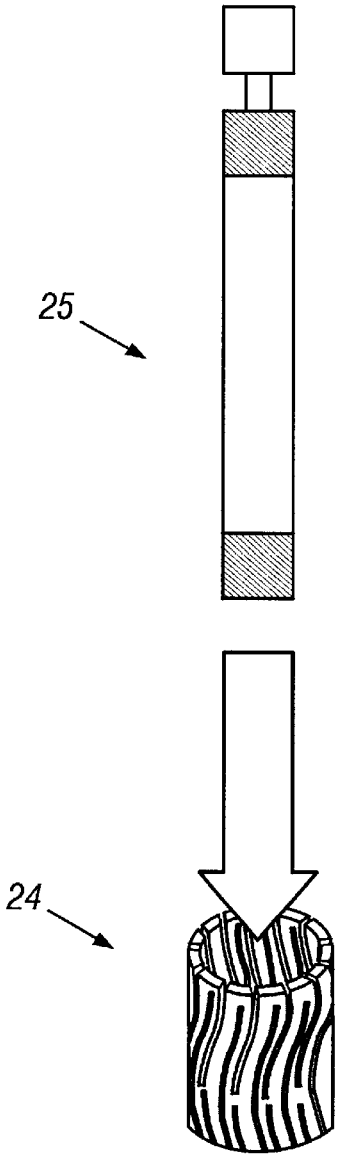
FIGS. 5A and 5B illustrate an expandable packer type of deployment device.
Figure 5B:
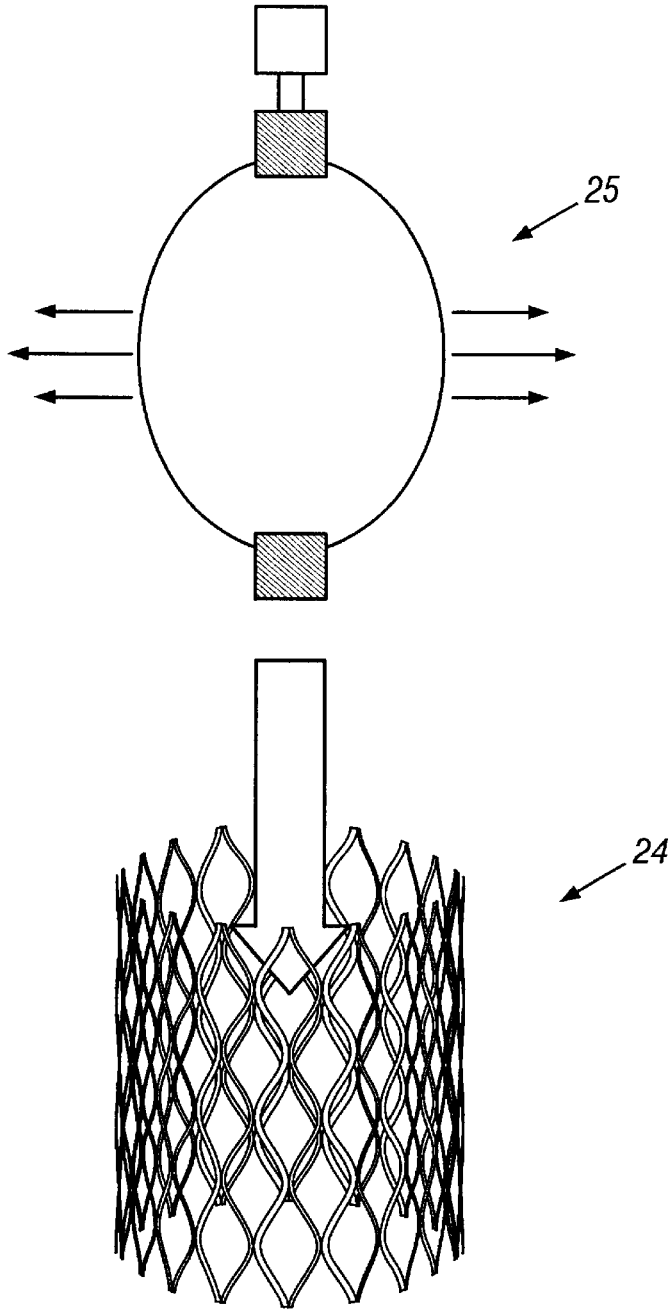

An inflatable packer element is shown in FIGS. 5A and 5B and is a device with an inflatable bladder, element, or bellows incorporated into the bistable expandable tubular system bottom hole assembly. In the illustration of FIG. 5A, the inflatable packer element 25 is located inside the entire length, or a portion, of the initial collapsed state bistable tubular 24 and any bistable expandable connectors (not shown). Once the bistable expandable tubular system is at the correct deployment depth, the inflatable packer element 25 is expanded radially by pumping fluid into the device as shown in FIG. 5B. The inflation fluid can be pumped from the surface through tubing or drill pipe, a mechanical pump, or via a downhole electrical pump which is powered via wireline cable. As the inflatable packer element 25 expands, it forces the bistable expandable tubular 24 to also expand radially. At a certain expansion diameter, the inflatable packer element causes the bistable cells in the tubular to reach a critical geometry where the bistable "snap" effect is initiated, and the bistable expandable tubular system expands to its final diameter. Finally the inflatable packer element 25 is deflated and removed from the deployed bistable expandable tubular 24.

Figure 6A:
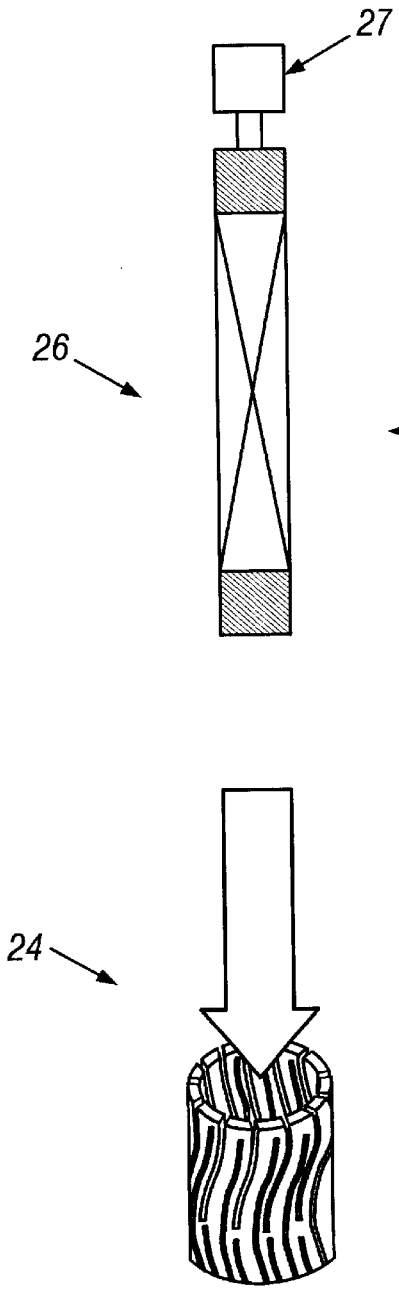
FIGS. 6A and 6B illustrate a mechanical packer type of deployment device.
Figure 6B:
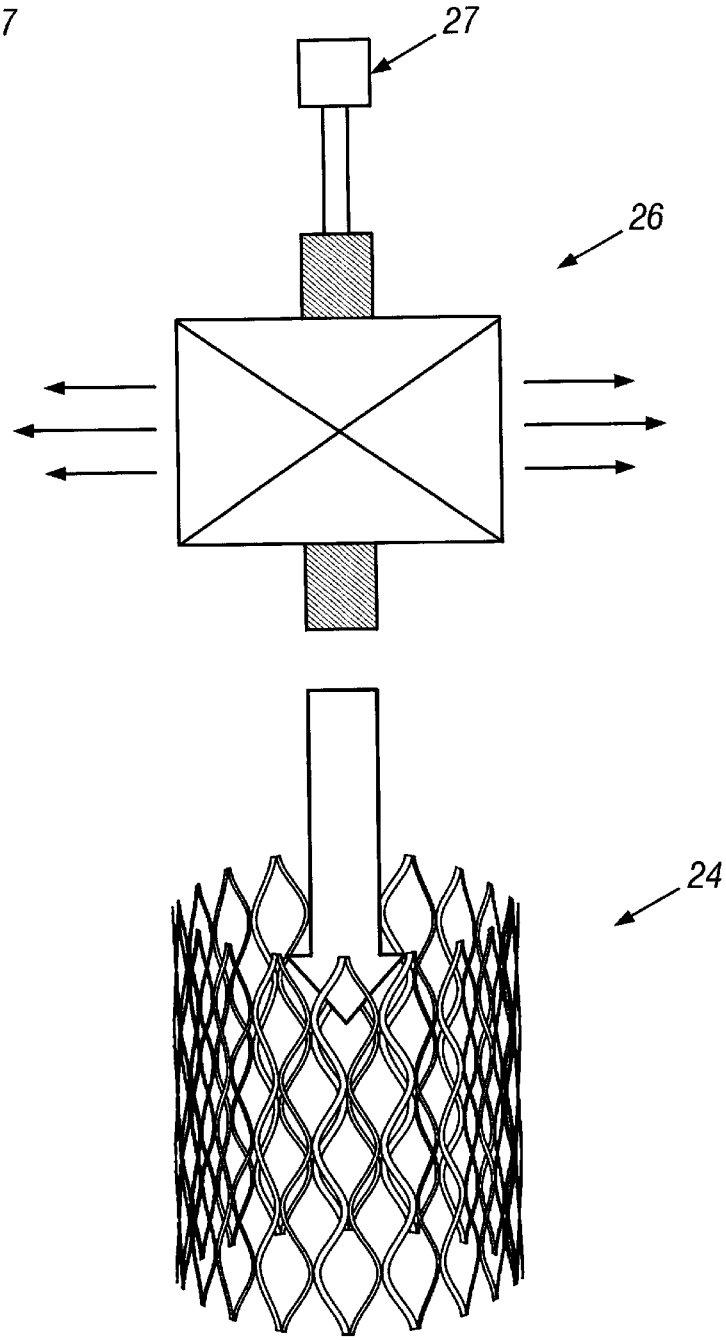

A mechanical packer element is shown in FIGS. 6A and 6B and is a device with a deformable plastic element 26 that expands radially when compressed in the axial direction. The force to compress the element can be provided through a compression mechanism 27, such as a screw mechanism, cam, or a hydraulic piston. The mechanical packer element deploys the bistable expandable tubulars and connectors in the same way as the inflatable packer element. The deformable plastic element 26 applies an outward radial force to the inner circumference of the bistable expandable tubulars and connectors, allowing them in turn to expand from a contracted position (see FIG. 6A) to a final deployment diameter (see FIG. 6B).

Figure 7A:
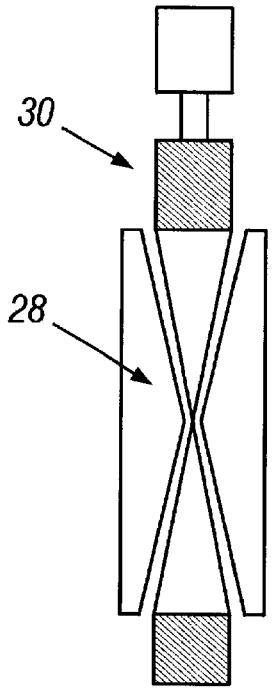
FIGS. 7A–7D illustrate an expandable swage type of deployment device.
Figure 7B:
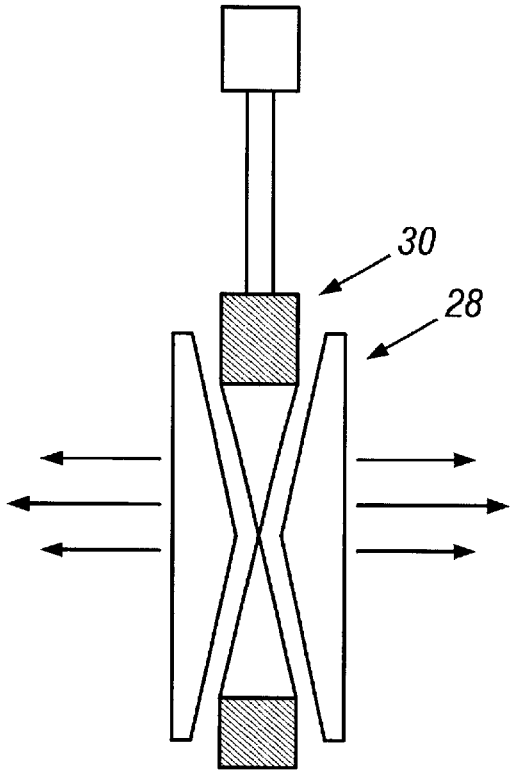
Figure 7C:
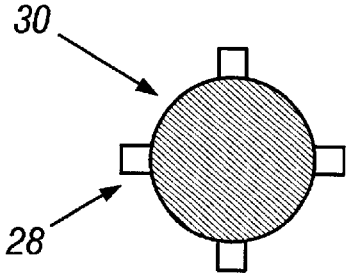
Figure 7D:
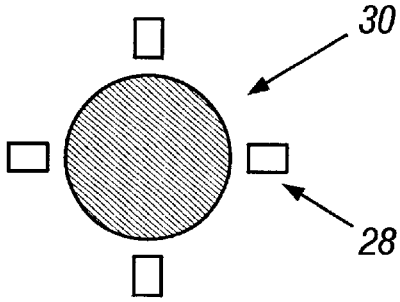

An expandable swage is shown in FIGS. 7A–7D and comprises a series of fingers 28 that are arranged radially around a conical mandrel 30. FIGS. 7A and 7C show side and top views respectively. When the mandrel 30 is pushed or pulled through the fingers 28 they expand radially outwards, as illustrated in FIGS. 7B and 7D. An expandable swage is used in the same manner as a mechanical packer element to deploy a bistable expandable tubular and connector.

Figure 8A:
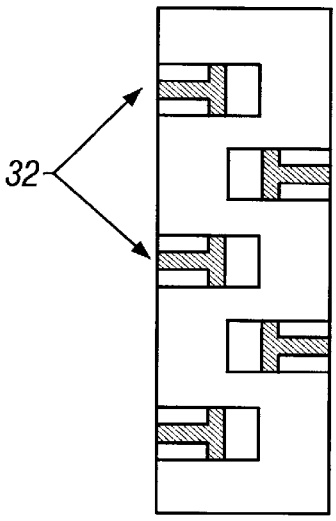
FIGS. 8A–8D illustrate a piston type of deployment device.
Figure 8B:
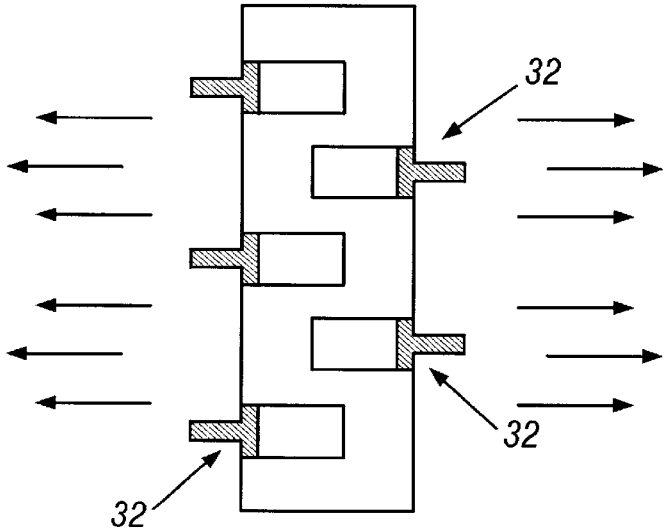
Figure 8C:
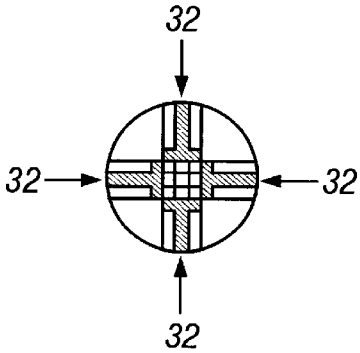
Figure 8D:
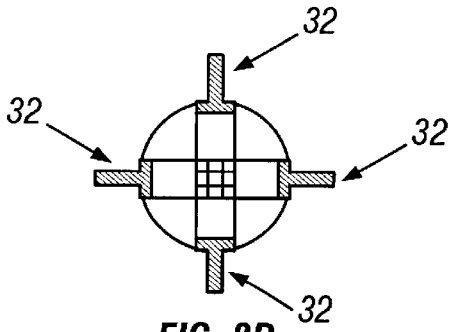

A piston type apparatus is shown in FIGS. 8A–8D and comprises a series of pistons 32 facing radially outwardly and used as a mechanism to expand the bistable expandable tubulars and connectors. When energized, the pistons 32 apply a radially directed force to deploy the bistable expandable tubular assembly as per the inflatable packer element. FIGS. 8A and 8C illustrate the pistons retracted while FIGS. 8B and 8D show the pistons extended. The piston type apparatus can be actuated hydraulically, mechanically or electrically.

Figure 9A:
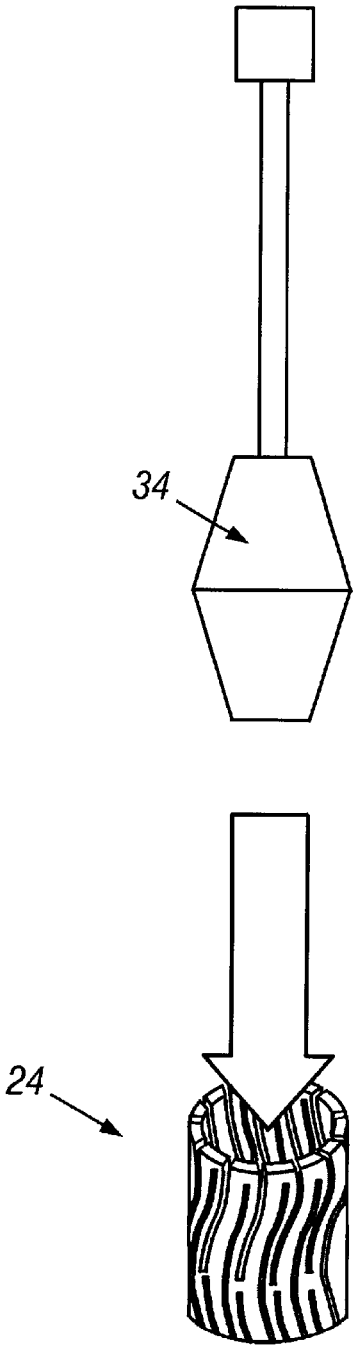
FIGS. 9A and 9B illustrate a plug type of deployment device.
Figure 9B:
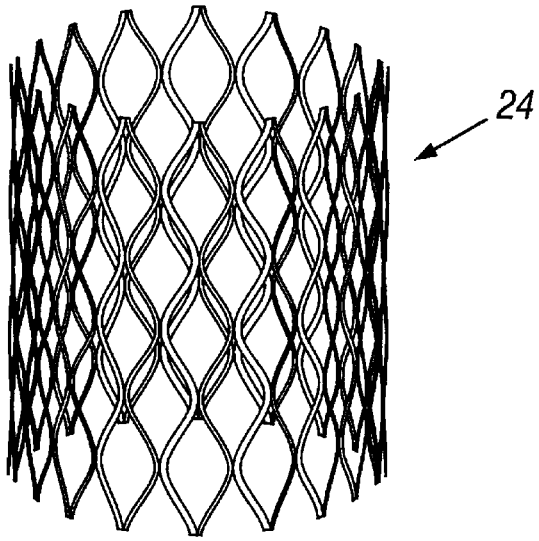

A plug type actuator is illustrated in FIGS. 9A and 9B and comprises a plug 34 that is pushed or pulled through the bistable expandable tubulars 24 or connectors as shown in FIG. 9A. The plug is sized to expand the bistable cells past their critical point where they will snap to a final expanded diameter as shown in FIG. 9B.

Figure 10A:
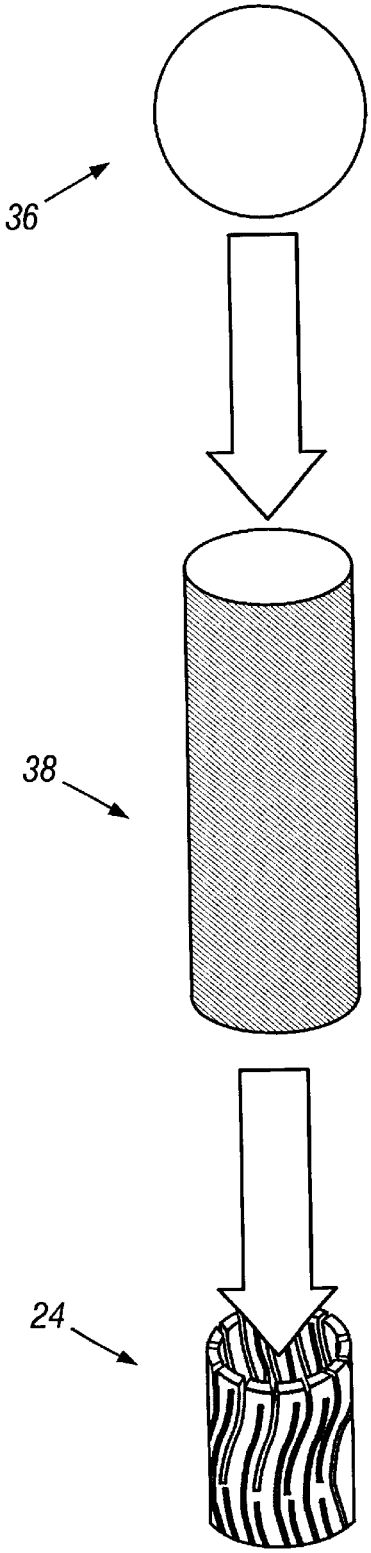
FIGS. 10A and 10B illustrate a ball type of deployment device.
Figure 10B:
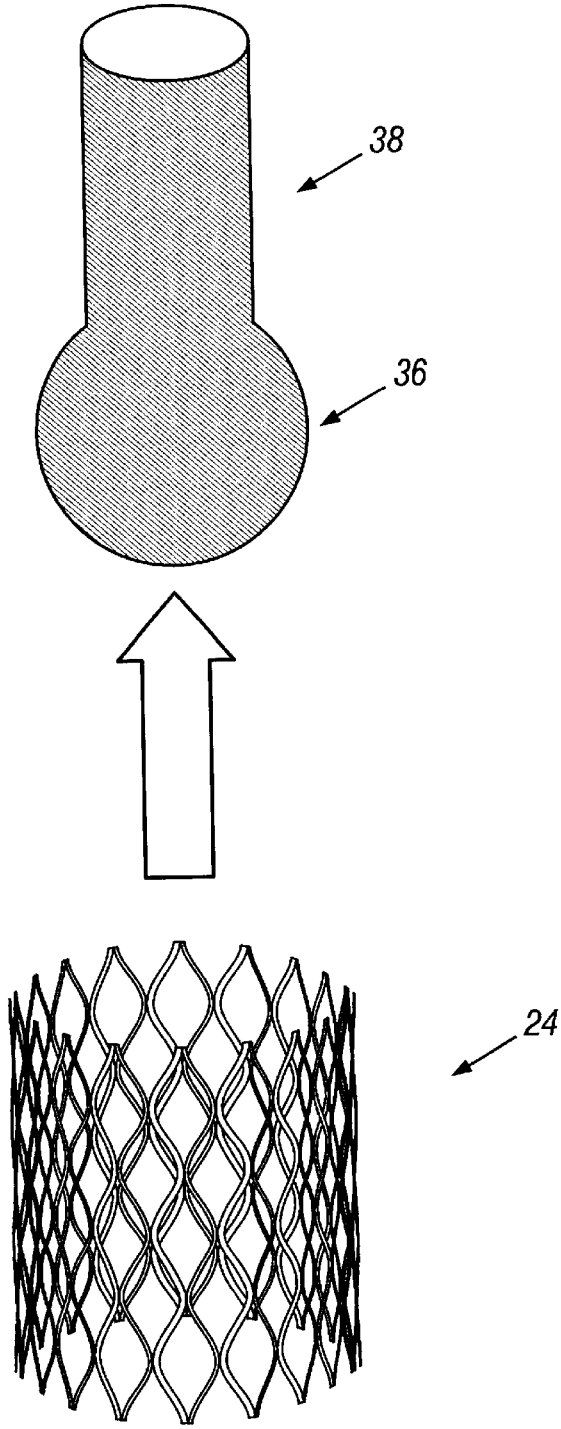

A ball type actuator is shown in FIGS. 10A and 10B and operates when an oversized ball 36 is pumped through the middle of the bistable expandable tubulars 24 and connectors. To prevent fluid losses through the cell slots, an expandable elastomer based liner 38 is run inside the bistable expandable tubular system. The liner 38 acts as a seal and allows the ball 36 to be hydraulically pumped through the bistable tubular 24 and connectors. The effect of pumping the ball 36 through the bistable expandable tubulars 24 and connectors is to expand the cell geometry beyond the critical bistable point, allowing full expansion to take place as shown in FIG. 10B. Once the bistable expandable tubulars and connectors are expanded, the elastomer sleeve 38 and ball 36 are withdrawn.

Figure 12:
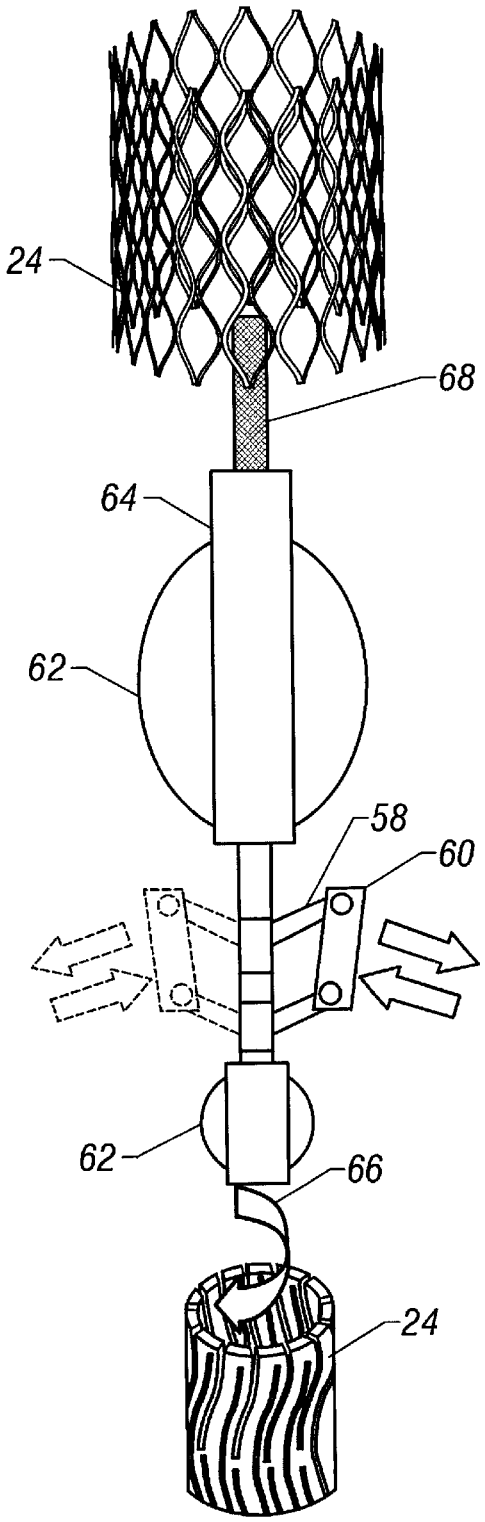
FIG. 12 illustrates a motor driven radial roller deployment device.

Radial roller type actuators also can be used to expand the bistable tubular sections. FIG. 12 illustrates a motor driven expandable radial roller tool. The tool comprises one or more sets of arms 58 that are expanded to a set diameter by means of a mechanism and pivot. On the end of each set of arms is a roller 60. Centralizers 62 can be attached to the tool to locate it correctly inside the wellbore and the bistable tubular 24. A motor 64 provides the force to rotate the whole assembly, thus turning the roller(s) circumferentially inside the wellbore. The axis of the roller(s) is such as to allow the roller(s) to rotate freely when brought into contact with the inner surface of the tubular. Each roller can be conically shaped in section to increase the contact area of roller surface to the inner wall of the tubular. The rollers are initially retracted and the tool is run inside the collapsed bistable tubular. The tool is then rotated by the motor 64, and rollers 60 are moved outwardly to contact the inner surface of the bistable tubular. Once in contact with the tubular, the rollers are pivoted outwardly a greater distance to apply an outwardly radial force to the bistable tubular. The outward movement of the rollers can be accomplished via centrifugal force or an appropriate actuator mechanism coupled between the motor 64 and the rollers 60.

The final pivot position is adjusted to a point where the bistable tubular can be expanded to the final diameter. The tool is then longitudinally moved through the collapsed bistable tubular, while the motor continues to rotate the pivot arms and rollers. The rollers follow a shallow helical path 66 inside the bistable tubular, expanding the bistable cells in their path. Once the bistable tubular is deployed, the tool rotation is stopped and the roller retracted. The tool is then withdrawn from the bistable tubular by a conveyance device 68 that also can be used to insert the tool.

Figure 13:
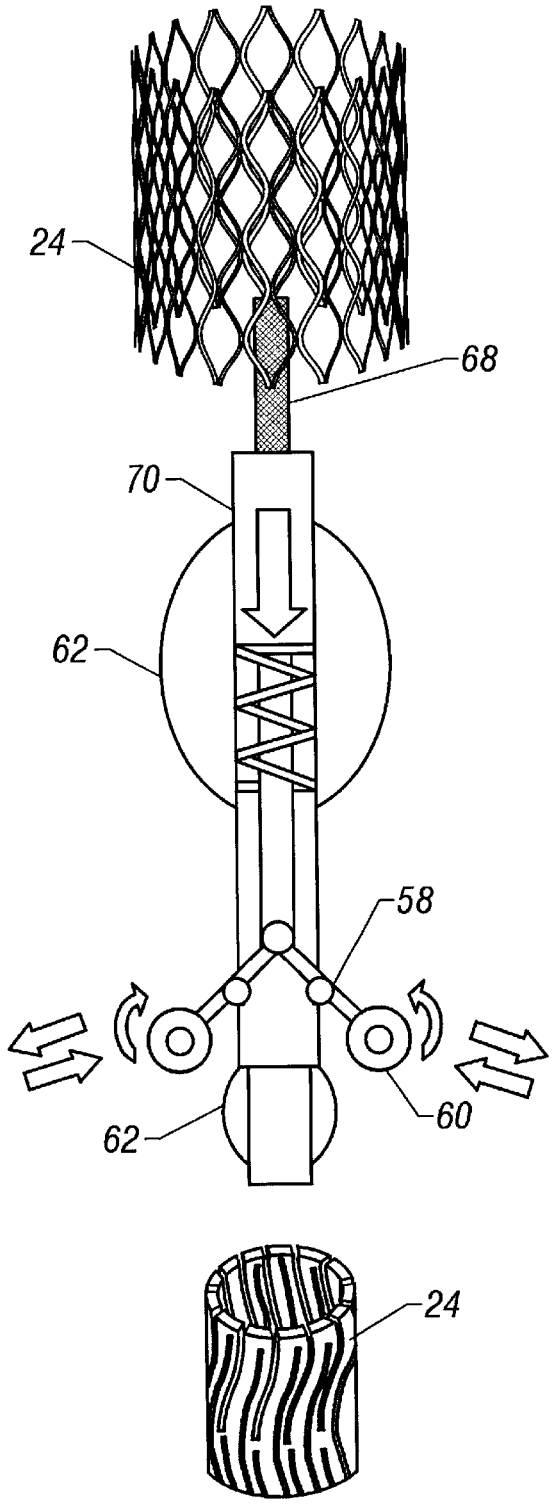
FIG. 13 illustrates a hydraulically driven radial roller deployment device.

FIG. 13 illustrates a hydraulically driven radial roller deployment device. The tool comprises one or more rollers 60 that are brought into contact with the inner surface of the bistable tubular by means of a hydraulic piston 70. The outward radial force applied by the rollers can be increased to a point where the bistable tubular expands to its final diameter. Centralizers 62 can be attached to the tool to locate it correctly inside the wellbore and bistable tubular 24. The rollers 60 are initially retracted and the tool is run into the collapsed bistable tubular 24. The rollers 60 are then deployed and push against the inside wall of the bistable tubular 24 to expand a portion of the tubular to its final diameter. The entire tool is then pushed or pulled longitudinally through the bistable tubular 24 expanding the entire length of bistable cells 23. Once the bistable tubular 24 is deployed in its expanded state, the rollers 60 are retracted and the tool is withdrawn from the wellbore by the conveyance device 68 used to insert it. By altering the axis of the rollers 60, the tool can be rotated via a motor as it travels longitudinally through the bistable tubular 24.

Power to operate the deployment device can be drawn from one or a combination of sources such as: electrical power supplied either from the surface or stored in a battery arrangement along with the deployment device, hydraulic power provided by surface or downhole pumps, turbines or a fluid accumulator, and mechanical power supplied through an appropriate linkage actuated by movement applied at the surface or stored downhole such as in a spring mechanism.

The bistable expandable tubular system is designed so the internal diameter of the deployed tubular is expanded to maintain a maximum cross-sectional area along the expandable tubular. This feature enables mono-bore wells to be constructed and facilitates elimination of problems associated with traditional wellbore casing systems where the casing outside diameter must be stepped down many times, restricting access, in long wellbores.

The bistable expandable tubular system can be applied in numerous applications such as an expandable open hole liner where the bistable expandable tubular 24 is used to support an open hole formation by exerting an external radial force on the wellbore surface. As bistable tubular 24 is radially expanded, the tubular moves into contact with the surface forming wellbore 29. These radial forces help stabilize the formations and allow the drilling of wells with fewer conventional casing strings. The open hole liner also can comprise a material, e.g. a wrapping, that reduces the rate of fluid loss from the wellbore into the formations. The wrapping can be made from a variety of materials including expandable metallic and/or elastomeric materials. By reducing fluid loss into the formations, the expense of drilling fluids can be reduced and the risk of losing circulation and/or borehole collapse can be minimized.

Liners also can be used within wellbore tubulars for purposes such as corrosion protection. One example of a corrosive environment is the environment that results when carbon dioxide is used to enhance oil recovery from a producing formation. Carbon dioxide ($CO_2$) readily reacts with any water ($H_2O$) that is present to form carbonic acid ($H_2CO_3$). Other acids can also be generated, especially if sulfur compounds are present. Tubulars used to inject the carbon dioxide as well as those used in producing wells are subject to greatly elevated corrosion rates. The present invention can be used to place protective liners, e.g. a bistable tubular 24, within an existing tubular to minimize the corrosive effects and to extend the useful life of the wellbore tubulars.

Another exemplary application involves use of the bistable tubular 24 as an expandable perforated liner. The open bistable cells in the bistable expandable tubular allow unrestricted flow from the formation while providing a structure to stabilize the borehole.

Still another application of the bistable tubular 24 is as an expandable sand screen where the bistable cells are sized to act as a sand control screen. Also, a filter material can be combined with the bistable tubular as explained below. For example, an expandable screen element can be affixed to the bistable expandable tubular. The expandable screen element can be formed as a wrapping around bistable tubular 24. It has been found that the imposition of hoop stress forces onto the wall of a borehole will in itself help stabilize the formation and reduce or eliminate the influx of sand from the producing zones, even if no additional screen element is used.

The above described bistable expandable tubulars can be made in a variety of manners such as: cutting appropriately shaped paths through the wall of a tubular pipe thereby creating an expandable bistable device in its collapsed state; cutting patterns into a tubular pipe thereby creating an expandable bistable device in its expanded state and then compressing the device into its collapsed state; cutting appropriate paths through a sheet of material, rolling the material into a tubular shape and joining the ends to form an expandable bistable device in its collapsed state; or cutting patterns into a sheet of material, rolling the material into a tubular shape, joining the adjoining ends to form an expandable bistable device in its expanded state and then compressing the device into its collapsed state.

The materials of construction for the bistable expandable tubulars can include those typically used within the oil and gas industry such as carbon steel. They can also be made of specialty alloys (such as a monel, inconel, hastelloy or tungsten-based alloys) if the application requires.

The configurations shown for the bistable tubular 24 are illustrative of the operation of a basic bistable cell. Other configurations may be suitable, but the concept presented is also valid for these other geometries.

Figure 14:
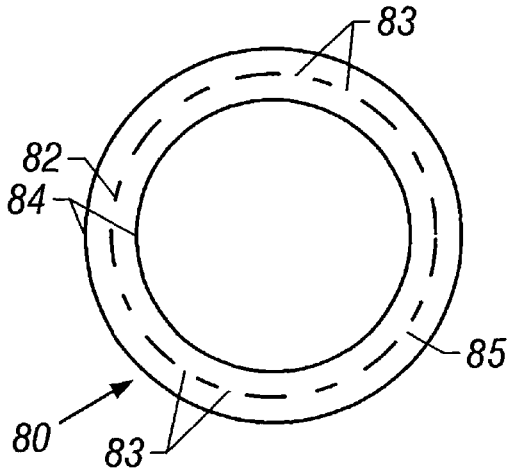
FIG. 14 is a cross sectional view of one embodiment of the packer of the present invention.
Figure 15:
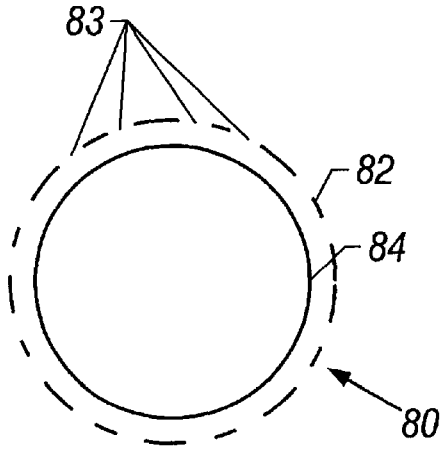
FIG. 15 is a cross sectional view of another embodiment of the packer of the present invention.

In FIGS. 14 and 15, a packer 80 formed of bistable cells is illustrated. The packer 80 has a tubular 82 formed of bistable cells 83, such as those previously discussed. In addition, the packer 80 has at least one seal 84 along at least a portion of its length. An exemplary seal 84 may include one or more layers positioned internally, externally, or both with respect to tubular 82. Additionally, the layer(s) may be intermixed with the openings formed in the cells.

FIG. 14 illustrates an embodiment having an internal and an external seal 84. FIG. 15 illustrates a packer 80 having only an internal seal 84. The seal 84 may be formed of an elastomer or other material. Further, the properties of the seal 84 allow it to at least match the expansion ratio of the tubular 82. Folds or other design characteristics of the seal 84 may be used to facilitate the expansion.

Also, a resin or catalyst 85 may be used to allow the seal 84 to harden after setting. In one alternative embodiment a resin or other flowable material is placed between the layers of seals 84 (as in FIG. 14). Once the packer 80 is placed in the well and expanded, the flowable material may be hardened or otherwise altered to improve the sealing characteristics of the packer 80. In some applications, hardening of the resin or other material requires heating of the material by a service tool. The packer 80 can be expanded as described herein, and may comprise a variety of bistable cells. In one embodiment of use, the packer 80 is deployed on a run-in tool that includes an expanding tool. The packer 80 is positioned at the desired location and expanded to seal against the walls of the casing or other tubular. Typically, the packer 80 is connected to a tubing or other conduit that extends downhole below the packer 80. The packer 80 provides a seal in the annulus to prevent or restrict fluid flow longitudinally in the well (the typical use for packers). The present invention also may act as a well anchor which includes or excludes the seal 84.

Figure 16:
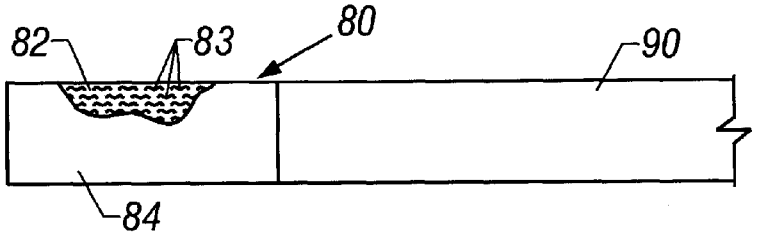
FIG. 16 is a side elevation view of an embodiment of the present invention in a contracted state.
Figure 17:
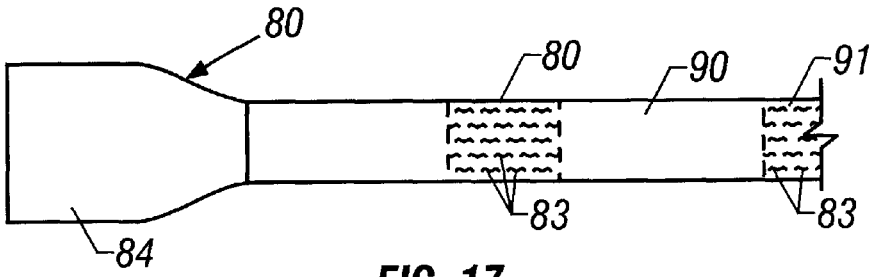
FIG. 17 is a side elevation view of an embodiment of the present invention in an expanded state.

In FIG. 16, an alternative embodiment is illustrated in which the packer 80 forms a portion of a conduit. In the embodiment shown, a well conduit 90 (such as a tubing) has a portion (marked as the packer 80) that is cut to form the bistable cells. The packer portion 80 has a seal 84 thereon as previously described. In FIG. 16, a portion of the seal material 84 is illustrated as removed to reveal the bistable cells 83 in the underlying tubular 82. In FIG. 17, the packer portion 80 is illustrated in its expanded state. It should be noted that in typical applications the well conduit 90 which does not have bistable cells formed therein, does not expand. Thus, one embodiment for attaching the well conduit to the packer 80 is to form the packer 80 as an integral part of the well conduit 90 (note that a welded connection resembles this embodiment and is an alternative method of forming the present invention). Other methods include conventional methods of non-integral connection.

In alternative embodiments, the well conduit has a plurality of bistable cell packers 80 formed thereon. In yet another alternative embodiment, a portion or portions 91 of the well conduit in addition to the packer portions 80 are formed of bistable cells so that these other portions also undergo expansion (see FIG. 17). The other portions may or may not have a material applied thereto. For example, the other portion may have a screen or filter material applied thereto to provide a well sand screen.

Figure 18A:
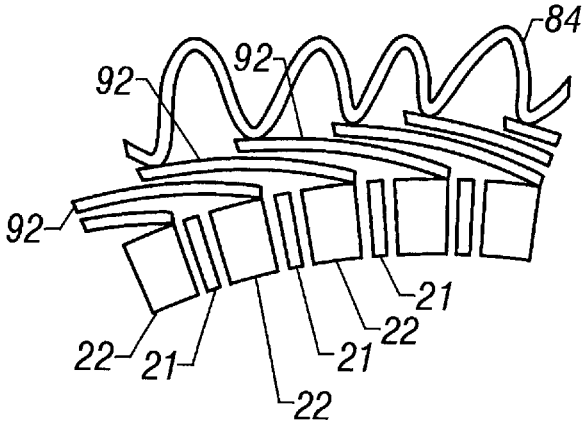
FIGS. 18A–C are schematic views of an alternative embodiment of the present invention.
Figure 18B:
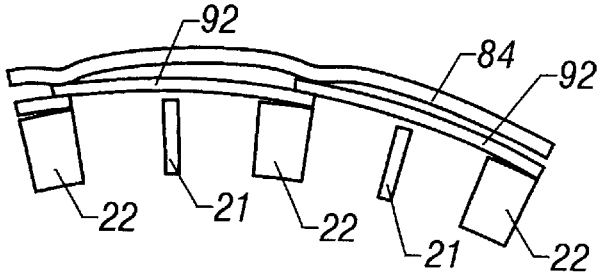
Figure 18C:
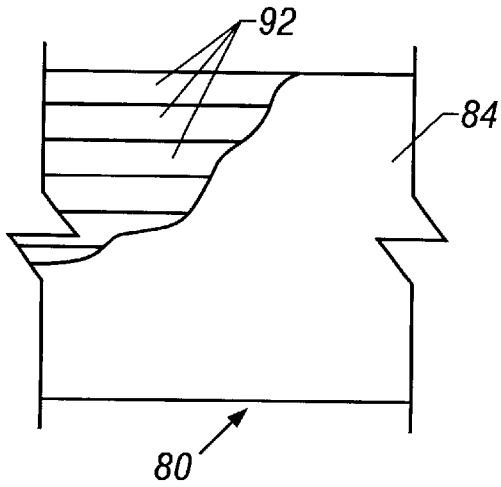

Referring to FIGS. 18A–C, an alternative design of the present invention is illustrated in a schematic, partial cross-sectional view. The expandable packer is shown in the retracted and expanded states, respectively, and in partial side elevational view (FIG. 18C). The packer shown includes a base tubular 82 formed of thin struts 21 and thick struts 22 forming bistable cells 23/83 as previously described. Slats 92 are attached to the tubing 82 at one edge and extend generally longitudinally in the embodiment shown (see FIG. 18C). Specifically, each slat 92 is attached to the tubing 82 at the thick struts 22, and the width of the slats is such that they overlap at least the adjacent slat when the tubing 82 is in the expanded state. Although illustrated as having a slat attached to each of the thick struts, the packer may have a slat attached to alternate thick struts 22 or in other configurations. Furthermore, the slats may extend in a direction other than the longitudinal direction. The slats 92 slide over one another during expansion so that the outside of the tubing 82 is covered by the overlapping slats 92.

A seal 84 may be attached to the slats 92 to provide the seal for the packer. Although shown in the figures as folded, the seal 84, may have other characteristics that facilitate its ability to expand with the slats 92 and tubular 82. Also, the seal 84 may have other characteristics previously mentioned (e.g., resin, internal seal, etc).

It should be noted that although described as a packer, the present invention may be used to provide isolation over a long length as opposed to a traditional packer or downhole tool which generally seals only a relatively short longitudinal distance. Thus, the present invention may be used in a manner similar to a casing to provide isolation for an extended length.

Figure 19:
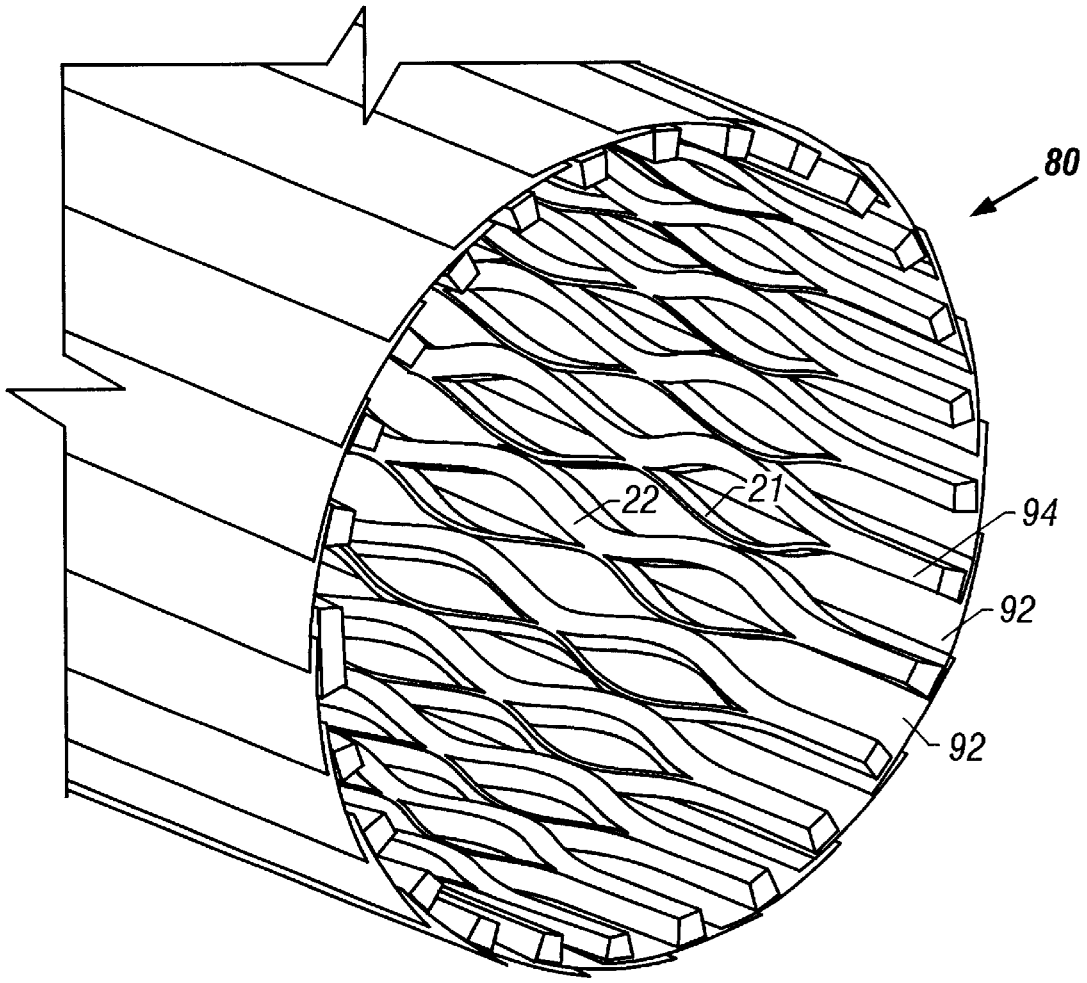
FIG. 19 is a perspective view of an alternative embodiment of the present invention.

In FIG. 19, a perspective view of packer 80 (or isolation device) having a plurality of slats 92 attached thereto is illustrated in an overlapping arrangement as previously described. The tubing 82 includes end extensions 94 that extend longitudinally from the endmost cells. The slats 92 may be attached to the end extensions 94, to certain portions of the thick struts 22 and/or to certain thick struts 22. In one embodiment, for example, the struts 92 are attached to the thick struts which are longitudinally aligned with the end extensions 94. Although generally shown as attached at an edge of the slats 92, the slats also may attach to the tubing 82 at a position intermediate the edges.

Figure 20:
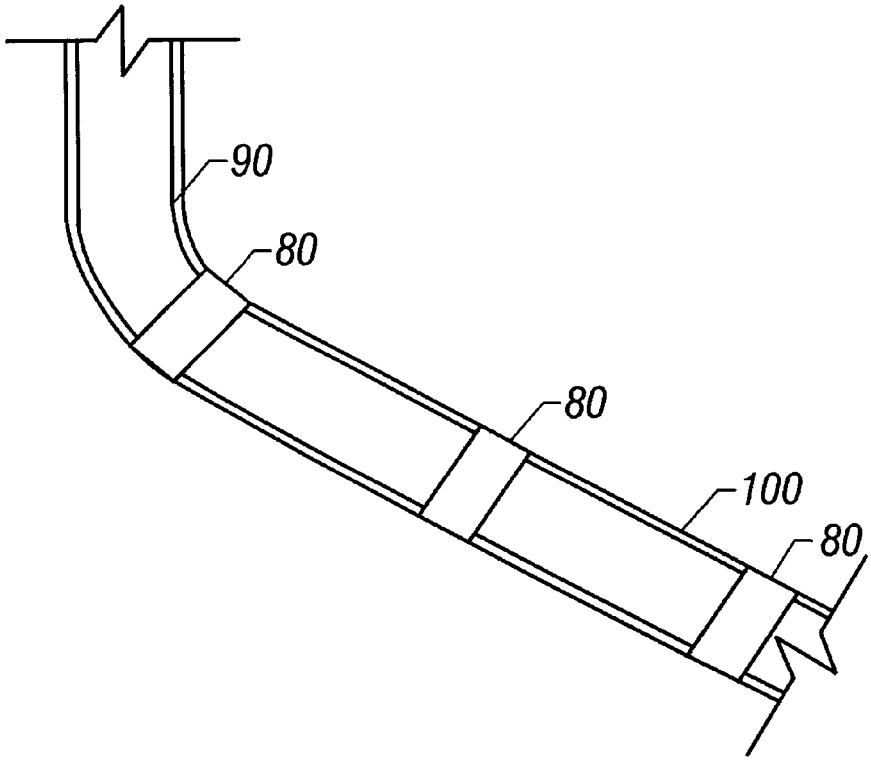
FIG. 20 is a schematic view of an alternative embodiment of the present invention.

In FIG. 20, an expandable tubing (or conduit) 90 is illustrated positioned in a well 100. The conduit 90 includes a plurality of spaced packers 80 or expandable sealing devices. The expandable packers 80 engage the wellbore wall preventing annular flow thereby. Therefore, any microannulus formed between the expandable tubing 90 and the well 100 (which may include a casing) is sealed in the longitudinal direction to restrict or prevent unwanted flow thereby. The conduit 90 may include one or more such packers 80, as desired, to control the flow. Further, the packers 80 may be spaced at regular intervals or at some other predetermined spacing to control the flow in the annulus as needed.

Figure 21:
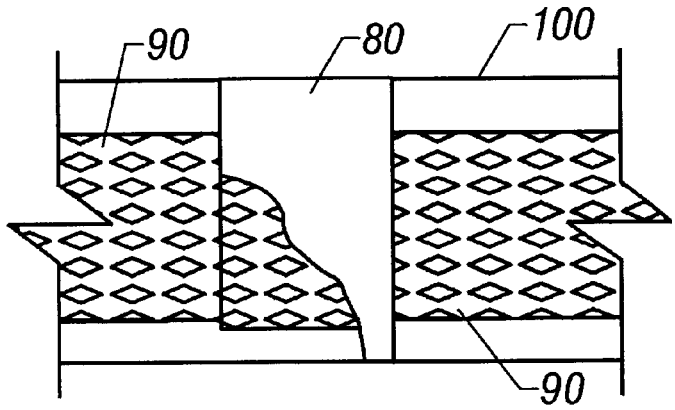
FIG. 21 is a schematic view of an alternative embodiment of the present invention.

In one example, illustrated schematically in FIG. 21, the individual joints of tubing 90 are interconnected by a packer 80 to compartmentalize each joint of conduit from the adjacent joint(s). The packer 80 can be a separate connector as shown in FIG. 21 or it can be formed as part of the joint. Accordingly, the packer 80 can be positioned at an end of the joint 90, in the middle of the joint 90, or at any other location along its length. In one embodiment both conduit 90 and packers 80, of FIGS. 20 and 21, are formed of bistable cells.

Figure 22:
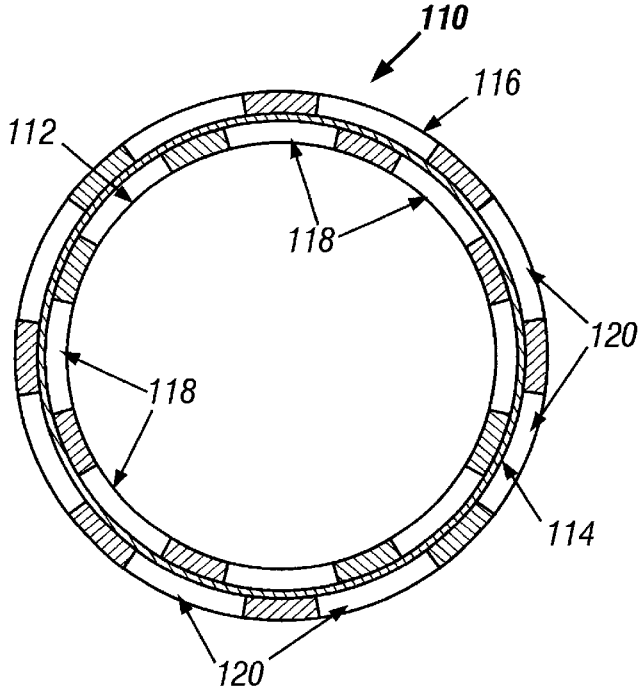
FIG. 22 is a cross-sectional view of an alternative embodiment of the present invention.

Another embodiment of a downhole device is illustrated in FIG. 22. In this embodiment, a downhole tool 110 is formed of an inner tube 112 surrounded by a fluid retention layer 114. An outer tube 116 is disposed to surround fluid retention layer 114.

Inner tube 112, fluid retention layer 114 and outer tube 116 are expandable. For example, inner tube 112 may comprise a plurality of bistable cells 118 to facilitate radial expansion towards the stable, expanded state. Similarly, outer tube 116 may comprise a plurality of bistable cells 120 also designed to facilitate expansion of outer tube 116 towards its stable, expanded state. The exact arrangement of bistable cells in the inner tube 112 and outer tube 116 are optimized according to different tube diameters and desired expansion characteristics. Fluid retention layer 114, on the other hand, may be made from a variety of materials that permit expansion. For example, the layer may be formed from a solid polymeric, e.g. rubber, sheet or an overlapping metallic foil able to uncoil as inner tube 112 and outer tube 116 are expanded. Such an overlapping metal foil can be formed from a plurality of individual, overlapping sheets or from a single coiled sheet.

In the embodiment illustrated, outer tube 116 is rotated slightly such that bistable cells 120 are out of phase with bistable cells 118. In other words, bistable cells 120 at least partially overlap bistable cells 118, as illustrated in FIG. 22. This arrangement creates a quasi-solid, fluid-tight structure. The structure can be used as a formation shut-off device, such as a packer, or as an expandable casing patch.

Figure 23:
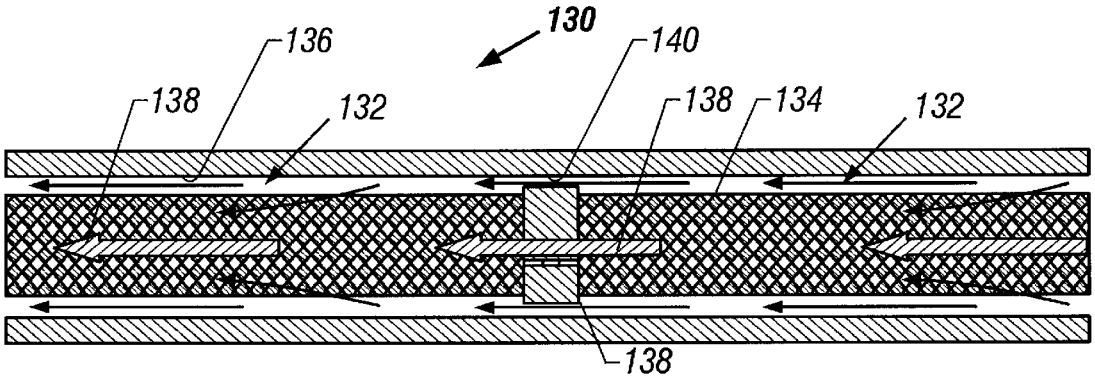
FIG. 23 is a cross-sectional view taken generally along the axis of a system for utilizing a wellbore isolation device according to one embodiment of the invention.
Figure 24:
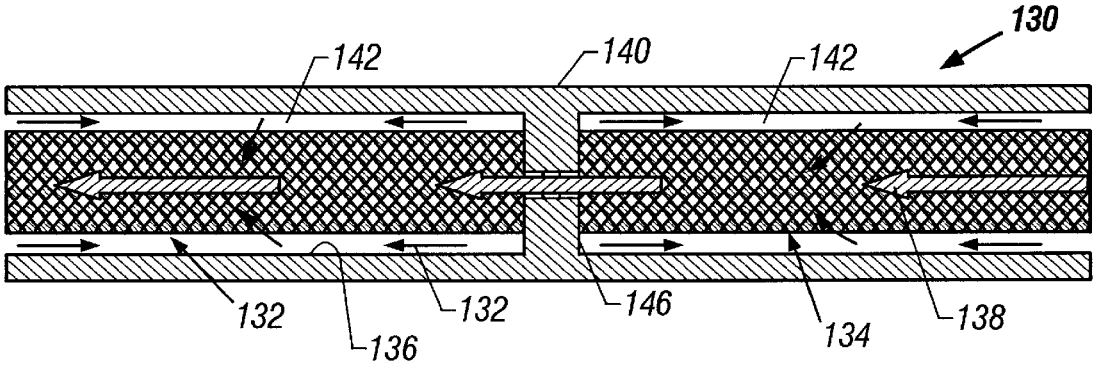
FIG. 24 is a view similar to FIG. 23 but showing an expandable component in its expanded state.

Another system for compartmentalizing portions of a wellbore is labeled as system 130 and illustrated in FIGS. 23 and 24. System 130 is designed to isolate an annular flow path 132 disposed between a sand screen 134, or other tubular downhole device, and a formation wall 136 defining the wellbore.

During operation of sand screen 134, fluid is drawn from formation wall 136 into the interior of sand screen 134 and produced along a main production fluid path 138. However, if uninterrupted, flow can also be created along annular flow path 132 between sand screen 134 and formation wall 136. This flow along the wellbore wall potentially leads to a variety of problems, such as sanding or formation collapse.

Accordingly, a flow isolation device 140 is mounted to sand screen 134 at one or more desired intervals. Similar to a packer, flow isolation device 140 isolates portions 142 of the annulus between sand screen 134 and formation wall 136, as best illustrated in FIG. 24. This isolation blocks or at least inhibits the detrimental flow along annular flow path 132. In one embodiment, flow isolation device 140 can be disposed through sand screen 134 at joints or intervals that separate one expandable screen section from the next. In other embodiments, however, the flow isolation device 140 is placed at a variety of desired locations along sand screen 134. At any of these locations, flow isolation device 140 can be expanded from a contracted state 144, as illustrated in FIG. 23, to an expanded state 146 that creates isolated portions 142 of the annulus, as illustrated in FIG. 24.

An exemplary flow isolation device 140 comprises an expandable device formed of bistable cells, as discussed above, that permit the device to be moved from contracted state 144 to expanded state 146 when an expansion device is moved through sand screen 134. If the flow isolation device 140 extends radially inwardly into flow path 138 in its contracted state 144, then the expansion mechanism can force flow isolation device 140 to its expanded state 146 without further expanding sand screen 134. Alternatively, both sand screen 134 and flow isolation device 140 can be expanded together until flow isolation device 140 is moved to its expanded state proximate formation wall 136. Flow isolation device 140 also may be formed from a variety of other materials, such as rubber jackets, designed to expand outwardly and seal the wellbore. Regardless of the specific design, blocking all or at least a substantial portion of this unwanted annular flow contributes to the function and longevity of production in a given wellbore.

The particular embodiments disclosed herein are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below.

What is claimed is:

1. A wellbore isolation device, comprising:

an expandable component having a wellbore isolation region, the wellbore isolation region comprising a bistable cell layer that can be expanded to limit fluid flow along a wellbore.

2. The wellbore isolation device as recited in claim 1, wherein the expandable component comprises a packer.

3. The wellbore isolation device as recited in claim 2, wherein the bistable cell layer comprises a plurality of bistable cells.

4. The wellbore isolation device as recited in claim 3, further comprising a seal disposed about the bistable cell layer.

5. The wellbore isolation device as recited in claim 1, further comprising a sand screen, wherein the expandable component is coupled to the sand screen.

6. The wellbore isolation device as recited in claim 1, wherein the bistable cell layer comprises a plurality of bistable cells.

7. The wellbore isolation device as recited in claim 1, wherein the bistable cell layer comprises an inner layer and an outer layer.

8. The wellbore isolation device as recited in claim 7, wherein the inner layer and the outer layer are tubular.

9. The wellbore isolation device as recited in claim 8, wherein the inner layer and the outer layer each comprise a plurality of bistable cells.

10. The wellbore isolation device as recited in claim 1, further comprising a plurality of overlapping slats connected to the bistable cell layer.

11. A wellbore isolation device, comprising:

an expandable component having a wellbore isolation region, the wellbore isolation region comprising a bistable cell layer that can be expanded to limit fluid flow along a wellbore, the bistable cell layer comprising an inner layer and an outer layer, wherein the inner layer and the outer layer are tubular and each comprises a plurality of bistable cells, the expandable component further comprising a fluid retention layer disposed between the inner layer and the outer layer.

12. A wellbore isolation device, comprising:

an expandable component having a wellbore isolation region, the wellbore isolation region comprising a bistable cell layer that can be expanded to limit fluid flow along a wellbore, the bistable cell layer comprising an inner layer and an outer layer, wherein the inner layer and the outer layer are tubular and each comprises a plurality of bistable cells, wherein the bistable cells of the outer layer are out of phase with the bistable cells of the inner layer.

13. A method for isolating regions of a well, comprising:

placing a packer with a layer of bistable cells at a desired location in a wellbore; and expanding the packer.

14. The method as recited in claim 13, further comprising deploying a seal layer around the layer of bistable cells.

15. The method as recited in claim 13, further comprising forming the bistable cells through a layer of metallic material.

16. The method as recited in claim 15, further comprising wrapping the metallic material into a generally tubular configuration.

17. A packer, comprising:

a tubular formed of a plurality of bistable cells; and a seal member disposed along at least a portion of the tubular.

18. The packer as recited in claim 17, wherein the seal member comprises an internal seal.

19. The packer as recited in claim 18, wherein the seal member comprises an external seal.

20. The packer as recited in claim 17, wherein the seal member comprises an external seal.

21. The packer as recited in claim 17, wherein the seal member has an expansion ratio that at least matches an expansion ratio of the tubular.

22. The packer as recited in claim 17, further comprising a resin, wherein the seal member expands and the resin facilitates hardening of the seal member after expansion.

23. The packer as recited in claim 17, further comprising a catalyst, wherein the seal member expands and the catalyst facilitates hardening of the seal member after expansion.

24. The packer as recited in claim 17, wherein the seal member comprises a plurality of layers.

25. The packer as recited in claim 17, wherein the tubular forms a portion of a well conduit.

26. The packer as recited in claim 17, further comprising a plurality of overlapping slats mounted to the tubular.

27. The packer as recited in claim 26, further comprising a seal mounted to the slats.

28. A packer, comprising:

a tubular formed of a plurality of bistable cells; and a seal member disposed along at least a portion of the tubular, the tubular forming a portion of a well conduit, wherein the well conduit comprises at least one additional region of bistable cells.

29. A system for isolating a portion of a wellbore, comprising:

means for forming an isolation device with a plurality of bistable cells; and means for expanding the plurality of bistable cells within a wellbore.

30. A system for forming at least a partial seal along a wellbore, comprising:

a conduit patch having an expandable tubular component comprising at least one bistable cell;

a seal coupled to the expandable tubular component; and at least one of a resin and a catalyst to facilitate hardening of the seal after expansion of the expandable tubular component.

31. The system as recited in claim 30, wherein the at least one bistable cell comprises a plurality of bistable cells.

32. A system for facilitating a desired fluid flow within a wellbore, comprising:

a tubular having a plurality of separate portions formed of bistable cells, wherein at least one portion of the plurality of separate portions comprises a packer.

33. The system as recited in claim 32, wherein the packer comprises a seal member.

34. The system as recited in claim 33, wherein the seal member is external to the tubular.

35. The system as recited in claim 33, wherein the seal member is internal to the tubular.

36. The system as recited in claim 32, wherein at least two portions of the plurality of separate portions comprise packers.

37. A system for facilitating a desired fluid flow within a wellbore, comprising:

a tubular having a plurality of separate portions formed of bistable cells with at least one portion of the plurality of separate portions comprising a packer, further, wherein at least one portion of the plurality of separate portions comprises a sand screen.

* * * * *